United States Patent [19]

Pittman

[11] 4,335,478

[45] Jun. 22, 1982

[54] PROTECTIVE CAPS FOR WATER SKI TOW LINE HANDLE

[76] Inventor: Alan K. Pittman, 6644 Smoketree Ave., Agoura, Calif. 91301

[21] Appl. No.: 116,906

[22] Filed: Jan. 30, 1980

[51] Int. Cl.[3] ..... A63C 11/10

[52] U.S. Cl. ..... 441/69

[58] Field of Search ..... 440/34; 9/310 R, 310 A; 114/253, 270; 280/821; 174/138 F; 339/26, 116 R

[56] References Cited

U.S. PATENT DOCUMENTS

| | | | |
|---|---|---|---|
| 2,119,294 | 5/1938 | Schaefer | 339/116 R |
| 3,238,291 | 3/1966 | Bosch | 174/138 F |
| 3,695,210 | 10/1972 | Stein | 9/310 A |
| 4,043,290 | 8/1977 | Holland | 9/310 A |
| 4,060,049 | 11/1977 | Rumbaugh | 9/310 A |

*Primary Examiner*—Trygve M. Blix
*Assistant Examiner*—Stephen P. Avila
*Attorney, Agent, or Firm*—David O'Reilly

[57] ABSTRACT

A protective end cap for a water ski tow line handle comprised of a sleeve and a cup adapted to snap over each end of the handle and cover the water ski tow line. The cup is adapted to cover the end of the handle including the portion of the tow line encircling the handle.

4 Claims, 4 Drawing Figures

PROTECTIVE CAPS FOR WATER SKI TOW LINE HANDLE

BACKGROUND

This invention relates to water ski tow line handles and more particularly relates to a protective cover for the ends of the handles.

For water skiing, a tow line is attached to each end of a handle. The line passes through a hole and encircles the handle, securing the tow line to the handle. Where the tow line encircles the handle, it is usually exposed and can cause chafing to the hands of the skier as well as expose the tow line to excessive wear. Devices have been designed to protect the hands of the skier from chafing and getting entangled in the line, such as the device disclosed and described in U.S. Pat. No. 4043290. However, a disadvantage of this device is that a portion of the tow line which wraps around the handle is still exposed.

SUMMARY

The purpose of the present invention is to provide protective end caps for a water ski tow rope line handle which completely covers the tow line, encircling the handle protecting the hands of the skier from chafing.

In the present invention, the water ski tow line passes through an aperture in the handle, encircles the handle, and is tied back on itself to secure the line. The end caps of the invention are comprised of a sleeve through which the tow line may slide, and an integrally attached cup shaped to snap over the end of the handle completely covering and encapsulating the end of the handle and the tow line. The end caps are made of sufficiently flexible material that they may be stretched to install them on the end of the handles and fit snugly around the line secured to the handle.

It is one object of the present invention to provide water ski tow line handle protective end caps which are inexpensive and easy to install.

It is another object of the present invention to provide protective end caps for a water ski tow handle which protect both the line and the hands of the skier.

Other objects, advantages and novel features of the invention will become apparent from the following detailed description when considered in conjunction with the accompanying drawings wherein.

DETAILED DESCRIPTION OF THE PREFERRED EMBODIMENT

Figure 1:
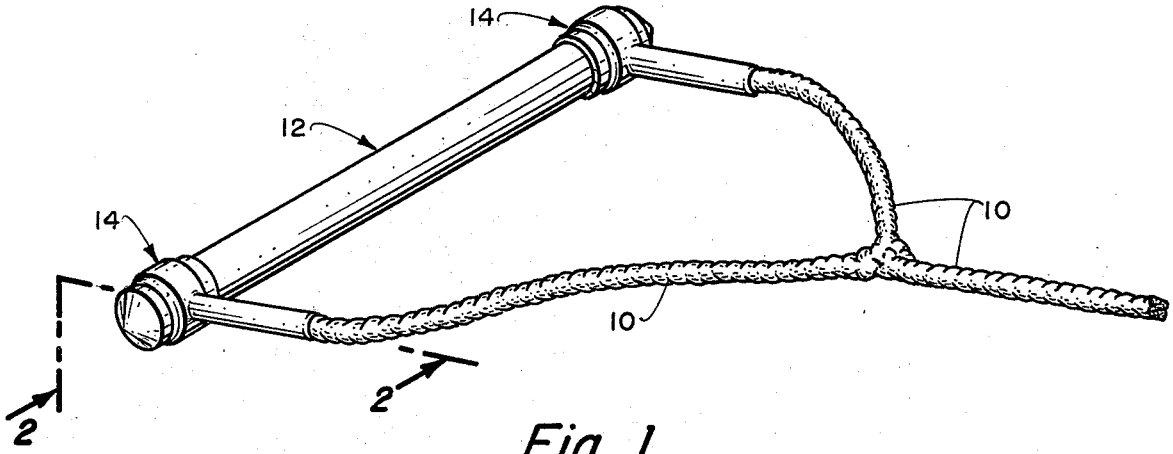
FIG. 1 is a perspective view of a waterski tow line and handle with the protective end caps of the invention installed.

Referring to FIG. 1, there is shown a Y-shaped water ski tow line 10 attached to a handle 12 having a free end for attachment to a ski tow boat (not shown). To protect the tow line 10 where it is attached to the handle 12, protective end caps 14 according to the invention are provided. These end caps completely cover the ends of the handle 12, including the portion where the tow line 10 is attached.

Figure 2:
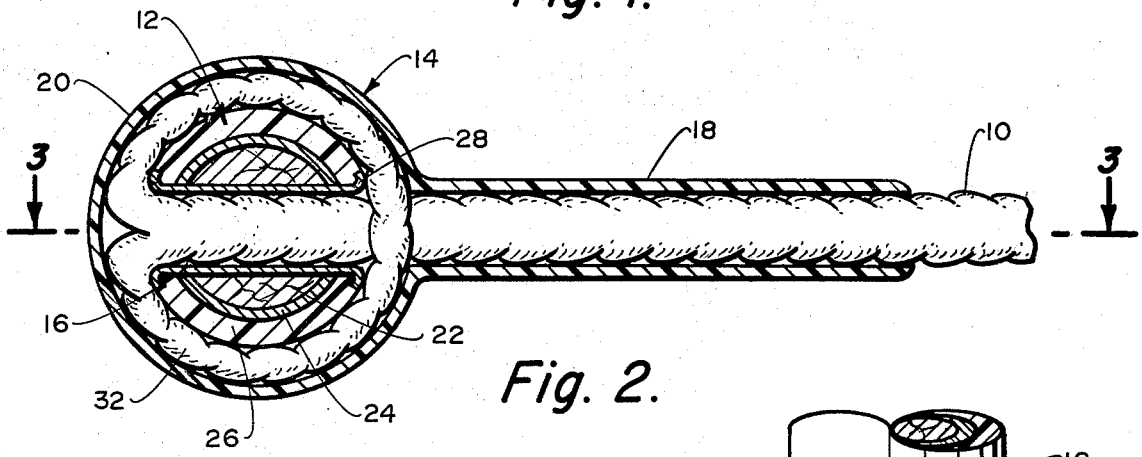
FIG. 2 is a sectional view taken at two two of FIG. 1.
Figure 4:
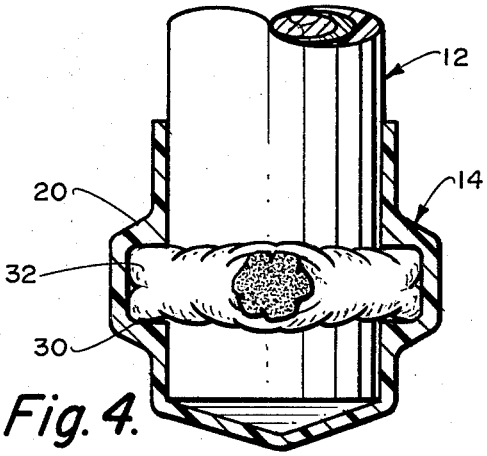
FIG. 4 is a sectional view taken at four four of FIG. 3.
Figure 3:
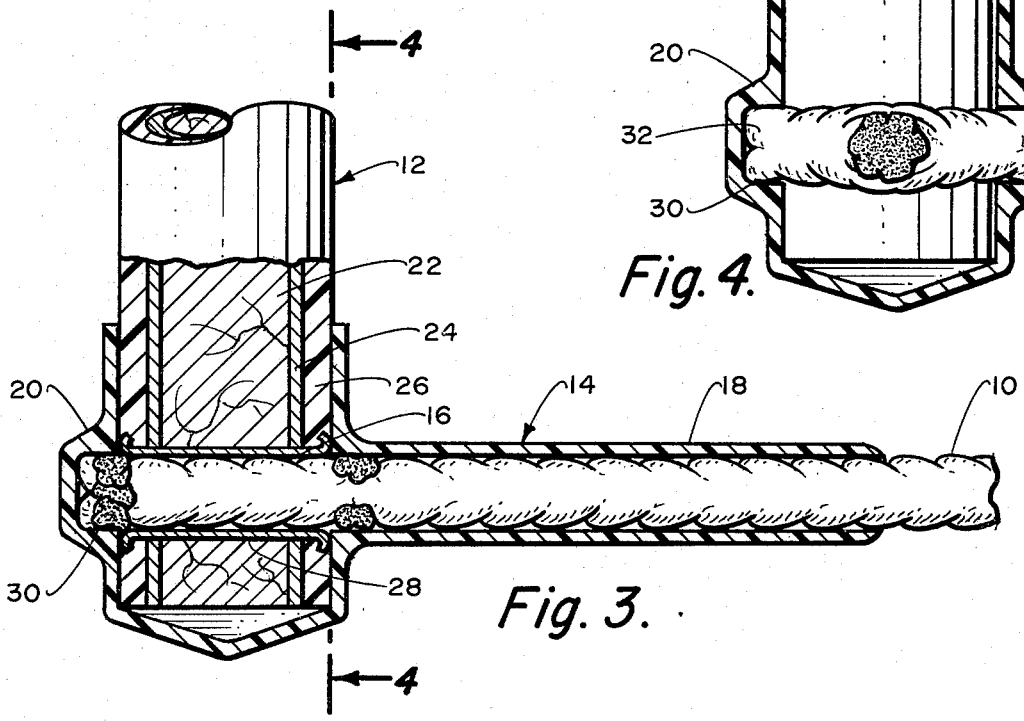
FIG. 3 is a sectional view taken at three three of FIG. 2.

The manner in which the protective end cap 14 covers and protects the ends of the handle 12 can be seen in FIGS. 2 through 4. The handle 12 is formed of an elongated cylindrical dowel 22, usually of wood, inside a metal tube 24 covered with a soft outer resilient layer such as a water-resistant rubber and cork mixture. The resilient cover provides a nonslip gripping surface. Through the ends of the handle are holes for attaching the tow line 10. A metal sleeve insert 28 is provided to provide a smooth surface to prevent wear on the tow line. The tow line is attached by loop 32 encircling the handle after the line has passed through the holes 16.

The protective end caps 14 are designed to cover completely the end of the handle 12 and a portion of the tow line.

Thus the end caps are formed with a sleeve 18 and cup 20 adapted to snap over each end of the handle 12. The protective end cap 14 is designed to specifically fit over the end of the handle 12 covering the tow line 10 and the aperture 16 to provide complete protection against chafing of the hands or excessive wear on the line. To secure the protective devices 14 on the handle 10 the cup 20 is formed with a groove 30 which fits snuggly over the line 10 where the loop 32 encircles the handle 12. The groove 30 is designed to fit tightly over the portion of the line 32 encircling the handle preventing the cup 20 from easily slipping off.

The protective end caps 14 are preferably formed of a stretchable, flexible plastic or rubber material with the sleeve 18 integrally molded on the cup 20. To install the end caps, the line 10 is first passed through the sleeve 18 and then attached with the loop 32 encircling the handle. The sleeve 18 is then slid up the line 10 so that the end caps 14 may be stretched and snapped over each end of handle 12 and pushed on until the encircling portion of the line 32 engages the annular groove 30 in the cup 20. The protective end caps 14 are thus completely retained on the water ski tow line handle by means of the sleeve covering a portion of the tow line 10 and extending outward from the handle and an integrally attached cup 20 which covers the portion of the two rope encircling the handle.

Thus, there has been shown and described a protective end cap for water ski tow line handles which is inexpensive to manufacture and simple to install. The protective end caps provide complete coverage of the line where it attaches to the handle preventing chafing of the hands and preventing wear of the line.

Obviously, many modifications and variations of the present invention are possible in light of the above teachings. It is therefore to be understood that the full scope of the invention is not limited to the details disclosed herein and may be practiced otherwise than as specifically described within the spirit and scope of the appended claims.

What is claimed is:

1. In a waterski tow rope handle having an elongate handle and a tow rope passing through holes and encircling each end of said elongate handle, the improvement comprising:

a cup adapted to slip over and cover the ends of said handle including the encircling rope; said cup having a groove adapted to fit snugly on said rope encircling said elongate handle;

a sheath extending outward from the side of said cup and formed integrally therewith through which said rope passes whereby said cup is retained on said handle.

2. The tow rope handle according to claim 1 wherein said cup and sheath are constructed of a stretchable plastic material whereby said cup may be stretched over the ends of said handles to snap in place covering said rope.

3. A waterski tow rope handle end cap comprising:

cup means for covering the ends of a handle;

said cup means adapted to cover a tow rope attached to the ends of said handle said cup including contoured grooves adpated to fit snugly over and around the tow rope attached to said handle;

sheath means extending outward from the side of said cup means and formed integrally therewith through which said tow rope passes whereby said end cap is secured to said tow rope handle.

4. The end cap according to claim 2 wherein said cup and sheath are formed of an integral homogeneous construction of a stretchable material whereby said caps may be stretched over the end of a ski tow rope handle.

* * * * *